US006554197B2

(12) United States Patent
Marbach et al.

(10) Patent No.: US 6,554,197 B2
(45) Date of Patent: Apr. 29, 2003

(54) GAS COOKTOP AND VESSEL FOR THE COOKTOP

(75) Inventors: Andreas Marbach, Traunwalchen (DE); Maximilian Neuhauser, Chieming (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 0 days.

(21) Appl. No.: 10/122,617

(22) Filed: Apr. 15, 2002

(65) Prior Publication Data

US 2002/0130190 A1 Sep. 19, 2002

Related U.S. Application Data

(63) Continuation of application No. PCT/EP00/10034, filed on Oct. 11, 2000.

(30) Foreign Application Priority Data

Oct. 14, 1999 (DE) ..... 199 49 601

(51) Int. Cl.[7] ..... A47J 27/00; F23N 1/08

(52) U.S. Cl. ..... 236/20 A; 126/374; 219/446.1

(58) Field of Search ..... 374/121; 236/69, 236/20 A; 219/446.1; 126/374

(56) References Cited

U.S. PATENT DOCUMENTS

| | | | | |
|---|---|---|---|---|
| 4,465,228 A | | 8/1984 | Mori et al. | 126/374 X |
| 4,614,441 A | | 9/1986 | Wolf | 374/130 |
| 4,646,963 A | * | 3/1987 | Delotto et al. | 236/20 A |
| 5,813,320 A | | 9/1998 | Frasnetti et al. | 99/333 |
| 5,945,017 A | | 8/1999 | Cheng et al. | 219/446.1 |
| 6,133,552 A | * | 10/2000 | Saulnier et al. | 219/446.1 |

FOREIGN PATENT DOCUMENTS

| | | | |
|---|---|---|---|
| DE | 33 41 234 C1 | 5/1985 | G01J/5/02 |
| EP | 0 074 108 A2 | 3/1983 | A47J/27/62 |
| EP | 0 441 364 A1 | 8/1991 | A47J/27/62 |
| EP | 0 802 374 A1 | 10/1997 | F24C/3/12 |
| FR | 2 633 482 A1 | 12/1989 | H05B/1/02 |
| GB | 2 072 334 A | 9/1981 | G01J/5/20 |
| JP | 08 094 086 | 4/1996 | F24C/3/12 |

* cited by examiner

*Primary Examiner*—William Wayner
(74) *Attorney, Agent, or Firm*—Laurence A. Greennberg; Werner H. Stemer; Ralph E. Locher

(57) ABSTRACT

A gas cooktop includes a gas supply control controlling flames applied to a cooking vessel through a control circuit connected to an infrared sensor that is directed at an infrared-radiation-generating outer surface region of the cooking vessel and receives temperature-related information from the surface of the vessel.

28 Claims, 2 Drawing Sheets

GAS COOKTOP AND VESSEL FOR THE COOKTOP

CROSS-REFERENCE TO RELATED APPLICATIONS

This application is a continuation of copending International Application No. PCT/EP00/10034, filed Oct. 11, 2000, which designated the United States.

BACKGROUND OF THE INVENTION

1. Field of the Invention

The invention lies in the field of appliances. The invention relates to a gas cooker with at least one cooking zone having a gas burner and a cooking vessel support, a temperature sensor for measuring the temperature of a cooking vessel on the cooking vessel support, and an electric circuit for setting the gas supply to the gas burner at a flow adjuster in dependence upon a setpoint value of a setpoint generator and in dependence upon the respectively measured temperature.

The gas cooker may be a gas oven or a gas cooktop or hob or some other type of gas cooking appliance. The flow adjuster is a gas cock or a controllable valve, in particular, a proportional valve. The cooking vessel may be a pot or a pan or a plate or the like, in or on which solid or liquid food can be prepared.

In the case of a gas cooktop disclosed in European Patent Application 0 802 374 A1, corresponding to U.S. Pat. No. 5,813,320 to Frasnetti et al., a temperature sensor that can be suspended in the cooking vessel has an electric cable with a plug, which can be plugged into a socket of an electric control circuit disposed on an operating panel. The temperature sensor interferes with the handling of food in the cooking vessel and the cable hinders the handling of the cooking vessel.

European Patent Application 0 074 108 A2, corresponding to U.S. Pat. No. 4,465,228 to Mori et al., likewise discloses a temperature sensor that can be suspended in a cooking vessel and also a temperature sensor disposed on the outside of a base of a cooking vessel, each of which sensors is connected to an electric heat monitoring circuit. In both embodiments, the required connecting lead between the temperature sensor and the electric circuit is troublesome. When a temperature sensor is attached to the underside of a vessel base there is the further disadvantage that a temperature falsified by the gas flames is measured, instead of the temperature of the food in the cooking vessel.

German Patent DE 33 41 234 C1, corresponding to U.S. Pat. No. 4,614,441 to Kurt, discloses a configuration for measuring the temperature of a cooking pot on an electric hot plate, in which the cooking pot is provided, in the transitional region from the pot base to the pot wall, with an irradiating area extending annularly around the cooking pot. A radiation sensor is directed at the irradiating area of the cooking pot placed onto the hot plate. This document discloses a configuration in which a wireless signal transmission link is formed as an infrared link and on the cooking pot there is provided a battery-powered transmitting device, which has to be removed for safety reasons when the cooking pot is cleaned. Such a configuration requires extensive construction measures and interferes with the handling of the cooking pot.

SUMMARY OF THE INVENTION

It is accordingly an object of the invention to provide a gas cooktop that overcomes the hereinafore-mentioned disadvantages of the heretofore-known devices of this general type and that provides a way in which the treatment temperature of food of the cooking vessel can be measured and controlled, in an open-loop or closed-loop manner, wirelessly and free from significant measuring errors, without requiring expensive special configuration features or measures for the cooking vessel that interfere with the handling of the cooking vessel or the preparation of food in the cooking vessel. With the foregoing and other objects in view, there is provided, in accordance with the invention, a gas cooktop including at least one cooking zone having a gas burner for receiving a gas supply and for distributing flames at a flame area, a flow adjuster fluidically connected to the gas burner and selectively supplying gas to the gas burner, a cooking vessel support, a sensing device for measuring a temperature of a cooking vessel placed on the cooking vessel support, the temperature sensing device having an optical channel and at least one infrared sensor for measuring temperature-dependent infrared radiation of the cooking vessel, a setpoint generator for setting a setpoint value, an electric circuit connected to the sensing device, to the setpoint generator, and to the flow adjuster, the circuit setting a level of the gas supply to the burner through the flow adjuster dependent upon the setpoint value received from the setpoint generator and dependent upon a measured temperature of the cooking vessel received from the sensing device, and a shielding disposed between the optical channel and the flame area, the shielding thermally separating the optical channel and the flames from one another.

The invention provides an infrared sensor for measuring temperature-dependent infrared radiation of the cooking vessel. Such a configuration has the advantage that no troublesome cable or other components for signal transmission between the infrared sensor, generating signals in dependence upon the temperature of the cooking vessel, and the electric circuit are required. As a result, there is no interference with the handling of the cooking vessel. Because the infrared sensor is disposed outside the cooking vessel, the preparation of food in the cooking vessel is also not disturbed. The infrared sensor can be disposed and aligned with the position of the cooking vessel such that the measured temperature corresponds substantially to the food located in the cooking vessel and is not significantly falsified by the heat in the direct vicinity of the gas flames.

In accordance with another feature of the invention, the support is disposed at the burner. Preferably, the support surrounds the burner.

In accordance with a further feature of the invention, the burner surrounds the infrared sensor.

In accordance with an added feature of the invention, the burner has a flow path for at least one of combustion gas and combustion air of the flames and the flow path is disposed at the infrared sensor to cool the sensing device with the at least one of the combustion gas and the combustion air.

In accordance with an additional feature of the invention, the electric circuit is a pot-detecting circuit detecting if the cooking vessel is on the support based upon temperature changes detected by the infrared sensor, and, dependent on the changes detected, actuates the flow adjuster and/or generates at least one of an optical signal and acoustic signal perceptible to an operator.

In accordance with yet another feature of the invention, the electric circuit is a pot-detecting circuit detecting if the cooking vessel is on the support based upon changes in it; infrared radiation per unit of time detected by the infrared sensor, and, dependent on the changes detected, actuates the flow adjuster and/or generates at least one of an optical signal and acoustic signal perceptible to an operator.

In accordance with yet a further feature of the invention, the electric circuit has a processor and is a pot-detecting circuit detecting if the cooking vessel is on the support based upon changes in infrared radiation per unit of time detected by the infrared sensor, and the circuit is programmed, dependent on the changes detected, to actuate the flow adjuster and/or generate at least one of an optical signal and acoustic signal perceptible to an operator.

In accordance with yet an added feature of the invention, the burner has a center and the infrared sensor is disposed at the center and is directed at a region of an outer surface area of a base of the cooking vessel when the cooking vessel is placed onto the support.

In accordance with yet an additional feature of the invention, the support surrounds the burner and the infrared sensor is disposed at the center of the burner and is directed at a region of an outer surface area of a base of the cooking vessel when the cooking vessel is placed onto the support.

In accordance with again another feature of the invention, the support surrounds the burner and defines a vessel receiving region and the infrared sensor is disposed at the center, is directed towards the vessel receiving region, and projects against a region of an outer surface area of a base of the cooking vessel when the cooking vessel is placed onto the support.

In accordance with again a further feature of the invention, the support defines a vessel receiving region for receiving the cooking vessel and the infrared sensor is disposed laterally next to the vessel receiving region and is directed toward an outer surface area of a wall of the cooking vessel when the cooking vessel is placed onto the support.

In accordance with again an added feature of the invention, the support defines a vessel receiving region for receiving the cooking vessel and the infrared sensor is disposed laterally next to the vessel receiving region, is directed toward the vessel receiving region, and projects against an outer surface area of a wall of the cooking vessel when the cooking vessel is placed onto the support.

In accordance with again an additional feature of the invention, the cooking vessel has an exterior surface and the exterior surface reflects infrared radiation permitting the sensing device to measure the temperature of the cooking vessel.

With the objects of the invention in view, there is also provided a cooking pot for the gas cooktop of the invention, the pot including a body having a surface including a sensor surface, the body defining an interior, the sensor surface disposed at a location on the surface at which the infrared sensor is directed, and the sensor surface having one of group consisting of a material, a color, and a surface finish reflecting infrared radiation in a temperature-dependent manner relatively higher than regions of the surface outside the sensor surface. Preferably, the surface is an exterior surface of the body.

In accordance with still another feature of the invention, the body has a bottom with a bottom surface and the sensor surface is disposed at the bottom surface.

In accordance with still a concomitant feature of the invention, the body has a side wall with a lateral exterior surface and the sensor surface is disposed at the lateral exterior surface.

Other features that are considered as characteristic for the invention are set forth in the appended claims.

Although the invention is illustrated and described herein as embodied in a gas cooktop, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
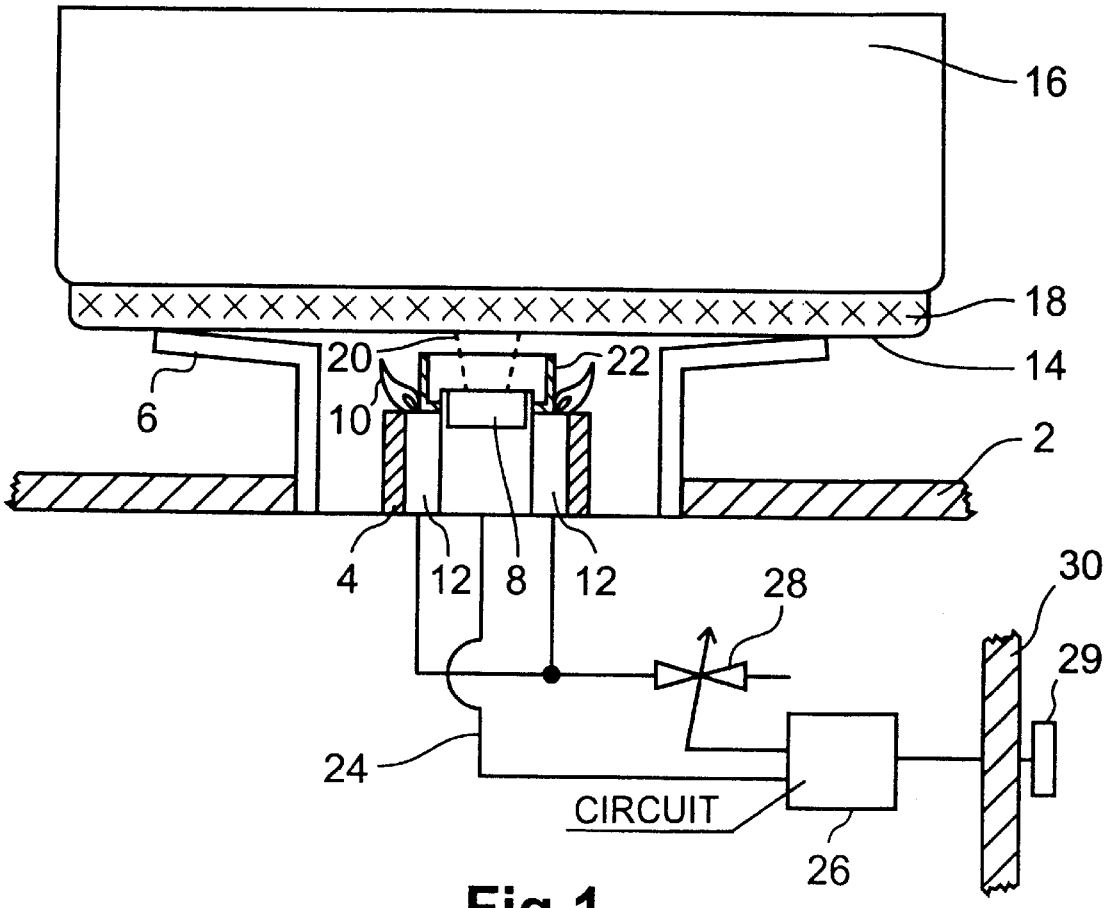
FIG. 1 is a fragmentary, partially cross-sectional and partially schematic circuit diagram of a gas cooktop and cooking vessel according to the invention.

Referring now to the figures of the drawings in detail and first, particularly to FIG. 1 thereof, there is shown, schematically and partly in vertical section, a gas cooktop 2 that can be fitted into a piece of kitchen furniture or be part of a gas oven. The cooktop 2 has a cooking zone, preferably more than one cooking zone, each with a gas burner 4 and a cooking vessel support 6 that surrounds the burner 4 and has a plurality of supporting arms.

At the center of the gas burner 4, an infrared sensor 8 is disposed such that the cold gas of the gas burner 4 producing the gas flames 10 flows past it on the gas path 12 and thereby cools it. As a result, the accuracy of the infrared measurement can be increased.

The infrared sensor 8 is directed toward the center of the lower base area of the vessel base 14 of a cooking vessel 16 that is standing on the cooking vessel support 6. As a result, the infrared sensor 8 measures the surface temperature of the cooking vessel base 14. The cooking vessel 16 may be a pot or a pan or a plate or the like for the preparation of food.

The cooking vessel base 14 is preferably provided, at least in its region covered in measuring terms by the infrared sensor 8, with a material (element or color or surface finish) that generates infrared radiation much more in a temperature-dependent manner than in other regions of the cooking vessel. Such a region is represented in FIG. 1 by a series of X markings 18.

So that the gas flames 10 do not influence the measuring signal, the optical channel 20 of the infrared sensor 8 is protected against the influence of the gas flames 10 by the protective tube 22 surrounding the sensor 8.

The infrared sensor 8 is connected by one or more electric leads 24 to an electric or electronic circuit 26, for adjustment, in the form of an open-loop control or in the form of a closed-loop control, of the gas supply to the gas burner 4 at a flow adjuster 28 in dependence upon a setpoint value of a manual setpoint generator 29 on an operating panel 30 and in dependence upon the temperature at the outer surface of the cooking vessel 16, respectively measured by the infrared sensor 8. An open-loop control circuit or a closed-loop control circuit of the electric or electronic circuit 26 can be the "adjustment" of the gas supply and can have a processor programmed to perform the circuit functions. The "flow adjuster" 28 may be a gas cock or a valve, for example, a proportional valve.

With such an infrared sensor 8 configuration, a pot detecting function can also be realized. For such a purpose, the electric or electronic circuit 26 may be configured as a pot detecting circuit that detects, in dependence upon temperature-induced changes in the infrared radiation per unit of time (which is measured by the infrared sensor), whether or not a cooking vessel 16 is standing on the cooking vessel support 6 over the gas burner 4, and, dependent upon such an inquiry, actuates the flow adjuster 26 and/or generates an optically perceptible signal from the operating panel, for example, or an acoustically perceptible signal from a non-illustrated acoustical signal device.

According to another embodiment, non-illustrated gas supply channels for the flames 10 are formed in the gas burner 4, and the gas flow path 12 serves not for gas but for air, which flows past the infrared sensor 8 for cooling the sensor 8. Apart from flowing to the infrared sensor 8, the air of the flow path 12 may also flow partly or entirely to the gas flames 10, in order to support the gas combustion.

In the embodiment of a gas cooktop according to the invention shown in FIGS. 2 and 3, the infrared sensor 8 is disposed laterally at a distance next to a cooking vessel 16 and is directed toward an outer circumferential area of the pot wall to measure infrared radiation generated in dependence upon the temperature thereof as described with reference to FIG. 1. The cooking vessel 16 has, in the region of the optical channel 20 of the infrared sensor 8 on the outer circumferential area 18-2, a material strip that extends around the entire vessel circumference, is identified by a marking 18-2 and is of a material (element or color or surface finish) or includes such a material that generates infrared radiation much more in a temperature-dependent manner than the remaining regions of the cooking vessel 16.

A shielding plate 32 between the flame ring of the flames 10 and the optical channel 20 of the infrared sensor 8 thermally separates the gas flames 10 and the optical channel 20 from one another.

Figure 2:
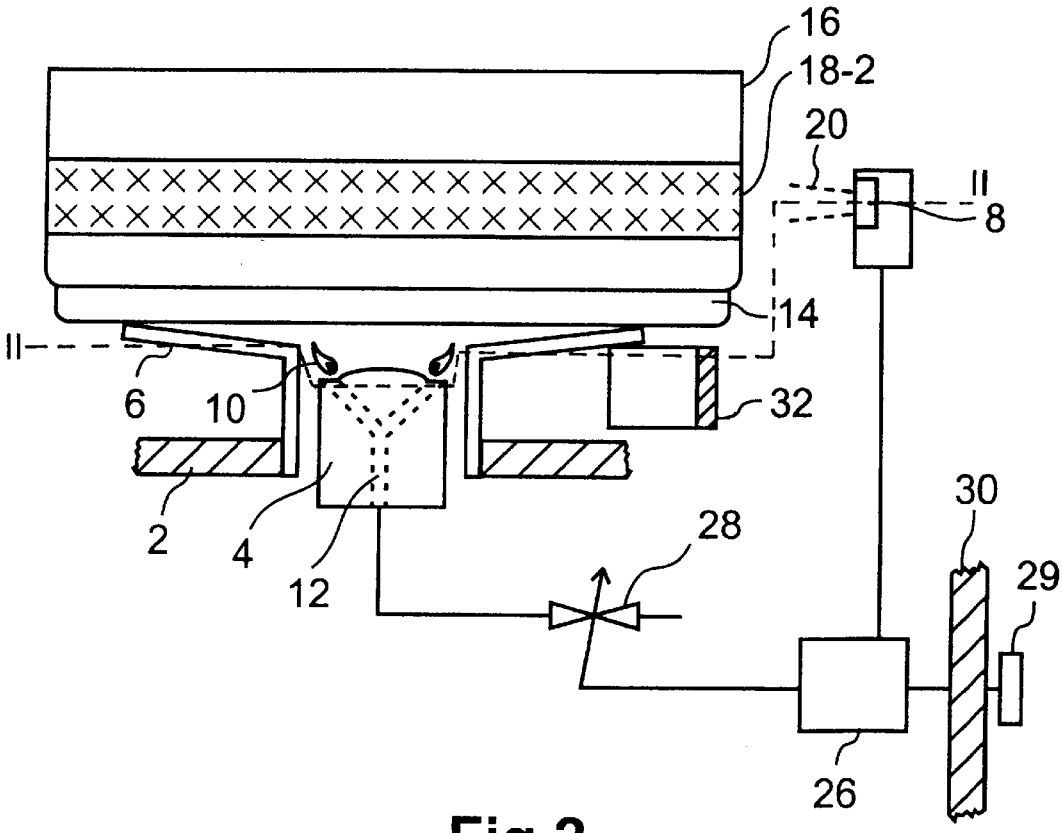
FIG. 2 is a fragmentary, partially cross-sectional and partially schematic circuit diagram of another embodiment of a gas cooktop and a cooking vessel of FIG. 1.
Figure 3:
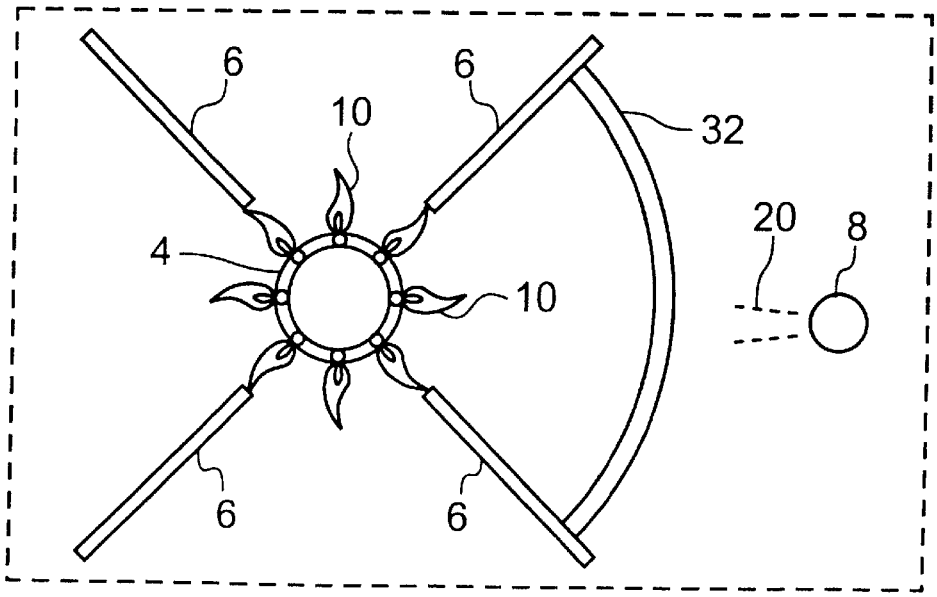
FIG. 3 is a diagrammatic illustration of the cooktop of FIG. 2 along section line II—II.

In all the embodiments according to FIGS. 1, 2, and 3, the output signal of the infrared sensor 8 is preferably processed in control electronics of the electric or electronic circuit 26. The controller formed by the circuit 26 generates an adjusting signal, which acts on the electrically operated flow adjuster 28. The adjustment of the desired setpoint temperature values of the cooking vessel 16 or of the vessel content takes place by automatic operation, and, alternatively, by the adjustment of the gas supply in normal operation, on the operating panel 30 by manual operating elements, for example, rotary coding switches or touch switches, as schematically represented for example by the setpoint generator 29.

Instead of only one infrared sensor 8, a plurality of infrared sensors 8 may be disposed in a distributed manner around the circumference of the cooking vessel 16. Consequently, mean temperature values can be formed and/or an optimum positioning of the cooking vessel 16 in relation to the infrared sensors 8 can be ascertained by the circuit 26.

We claim:

1. A gas cooktop, comprising:

at least one cooking zone having:

a gas burner for receiving a gas supply and for distributing flames at a flame area;

a flow adjuster fluidically connected to said gas burner and selectively supplying gas to said gas burner;

a cooking vessel support;

a sensing device for measuring a temperature of a cooking vessel placed on said cooking vessel support, said temperature sensing device having:

an optical channel; and at least one infrared sensor for measuring temperature-dependent infrared radiation of the cooking vessel;

a setpoint generator for setting a setpoint value;

an electric circuit connected to said sensing device, to said setpoint generator, and to said flow adjuster, said circuit setting a level of the gas supply to said burner through said flow adjuster dependent upon said setpoint value received from said setpoint generator and dependent upon a measured temperature of the cooking vessel received from said sensing device; and a shielding disposed between said optical channel and said flame area, said shielding thermally separating said optical channel and the flames from one another.

2. The cooktop according to claim 1, wherein said support is disposed at said burner.

3. The cooktop according to claim 2, wherein said support surrounds said burner.

4. The cooktop according to claim 1, wherein said burner surrounds said infrared sensor.

5. The cooktop according to claim 1, wherein:

said burner has a flow path for at least one of combustion gas and combustion air of the flames; and said flow path is disposed at said infrared sensor to cool said sensing device with said at least one of the combustion gas and the combustion air.

6. The cooktop according to claim 4, wherein:

said burner has a flow path for at least one of combustion gas and combustion air of the flames; and said flow path is disposed at said infrared sensor to cool said sensing device with said at least one of the combustion gas and the combustion air.

7. The cooktop according to claim 1, wherein said electric circuit is a pot-detecting circuit detecting if the cooking vessel is on said support based upon temperature changes detected by said infrared sensor, and, dependent on the changes detected, at least one of:

actuates said flow adjuster; and generates at least one of an optical signal and acoustic signal perceptible to an operator.

8. The cooktop according to claim 1, wherein said electric circuit is a pot-detecting circuit detecting if the cooking vessel is on said support based upon changes in infrared radiation per unit of time detected by said infrared sensor, and, dependent on the changes detected, at least one of:

actuates said flow adjuster; and generates at least one of an optical signal and acoustic signal perceptible to an operator.

9. The cooktop according to claim 1, wherein:

said electric circuit has a processor and is a pot-detecting circuit detecting if the cooking vessel is on said support based upon changes in infrared radiation per unit of time detected by said infrared sensor; and said circuit is programmed, dependent on the changes detected, to at least one of:

actuate said flow adjuster; and generate at least one of an optical signal and acoustic signal perceptible to an operator.

10. The cooktop according to claim 1, wherein:

said burner has a center; and said infrared sensor is disposed at said center and is directed at a region of an outer surface area of a base of the cooking vessel when the cooking vessel is placed onto said support.

11. The cooktop according to claim 10, wherein:

said support surrounds said burner; and said infrared sensor is disposed at said center of said burner and is directed at a region of an outer surface area of a base of the cooking vessel when the cooking vessel is placed onto said support.

12. The cooktop according to claim 10, wherein:

said support surrounds said burner and defines a vessel receiving region; and said infrared sensor:

is disposed at said center;

is directed towards said vessel receiving region; and projects against a region of an outer surface area of a base of the cooking vessel when the cooking vessel is placed onto said support.

13. The cooktop according to claim 1, wherein:

said support defines a vessel receiving region for receiving the cooking vessel; and said infrared sensor is disposed laterally next to said vessel receiving region and is directed toward an outer surface area of a wall of the cooking vessel when the cooking vessel is placed onto said support.

14. The cooktop according to claim 1, wherein:

said support defines a vessel receiving region for receiving the cooking vessel; and said infrared sensor:

is disposed laterally next to said vessel receiving region;

is directed toward said vessel receiving region; and projects against an outer surface area of a wall of the cooking vessel when the cooking vessel is placed onto said support.

15. The cooktop according to claim 1, wherein:

the cooking vessel has an exterior surface; and the exterior surface reflects infrared radiation permitting said sensing device to measure the temperature of the cooking vessel.

16. A cooking pot for a gas cooktop having at least one cooking zone with:

a gas burner for receiving a gas supply and for distributing flames at a flame area;

a flow adjuster fluidically connected to the burner and selectively supplying gas to the burner;

a cooking vessel support;

a sensing device for measuring a temperature of the cooking pot placed on the support, the temperature sensing device having:

an optical channel; and at least one infrared sensor for measuring temperature-dependent infrared radiation of the cooking pot;

a setpoint generator for setting a setpoint value;

an electric circuit connected to the sensing device, to the setpoint generator, and to the flow adjuster, the circuit setting a level of the gas supply to the burner through the flow adjuster dependent upon the setpoint value received from the setpoint generator and dependent upon a measured temperature of the cooking pot received from the sensing device; and a shielding disposed between the optical channel and the flame area, the shielding thermally separating the optical channel and the flames from one another;

the pot comprising:

a body having a surface including a sensor surface, said body defining an interior;

said sensor surface disposed at a location on said surface at which the infrared sensor is directed; and said sensor surface having one of group consisting of a material, a color, and a surface finish reflecting infrared radiation in a temperature-dependent manner relatively higher than regions of said surface outside said sensor surface.

17. The pot according to claim 16, wherein said surface is an exterior surface of said body.

18. The pot according to claim 16, wherein:

said body has a bottom with a bottom surface; and said sensor surface is disposed at said bottom surface.

19. The pot according to claim 16, wherein:

said body has a side wall with a lateral exterior surface; and said sensor surface is disposed at said lateral exterior surface.

20. A gas cooktop and cooking pot combination, the cooktop comprising:

at least one cooking zone having:

a gas burner for receiving a gas supply and for distributing flames at a flame area;

a flow adjuster fluidically connected to said gas burner and selectively supplying gas to said gas burner;

a cooking vessel support;

a sensing device for measuring a temperature of a cooking vessel placed on said cooking vessel support, said temperature sensing device having:

an optical channel; and at least one infrared sensor for measuring temperature-dependent infrared radiation of the cooking vessel;

a setpoint generator for setting a setpoint value;

an electric circuit connected to said sensing device, to said setpoint generator, and to said flow adjuster, said circuit setting a level of the gas supply to said burner through said flow adjuster dependent upon said setpoint value received from said setpoint generator and dependent upon a measured temperature of the cooking vessel received from said sensing device; and a shielding disposed between said optical channel and said flame area, said shielding thermally separating said optical channel and the flames from one another; and the cooking pot comprising:

a body having a surface including a sensor surface, said body defining an interior;

said sensor surface disposed at a location on said surface at which said infrared sensor is directed; and said sensor surface having one of group consisting of a material, a color, and a surface finish reflecting infrared radiation in a temperature-dependent manner relatively higher than regions of said surface outside said sensor surface.

21. The pot according to claim 20, wherein said surface is an exterior surface of said body.

22. The pot according to claim 20, wherein:

said body has a bottom with a bottom surface; and said sensor surface is disposed at said bottom surface.

23. The pot according to claim 20, wherein:

said body has a side wall with a lateral exterior surface; and said sensor surface is disposed at said lateral exterior surface.

24. In combination with a cooking pot having a body with a surface including a sensor surface, the body defining an interior, the sensor surface disposed at a location on the surface, and the sensor surface having one of group consisting of a material, a color, and a surface finish reflecting infrared radiation in a temperature-dependent manner relatively higher than regions of the surface outside the sensor surface, a gas cooktop, comprising:

at least one cooking zone having:

a gas burner for receiving a gas supply and for distributing flames at a flame area;

a flow adjuster fluidically connected to said gas burner and selectively supplying gas to said gas burner;

a cooking vessel support;

a sensing device for measuring a temperature of a cooking vessel placed on said cooking vessel support, said temperature sensing device having:

an optical channel; and at least one infrared sensor for measuring temperature-dependent infrared radiation of the cooking vessel at said sensor surface;

a setpoint generator for setting a setpoint value;

an electric circuit connected to said sensing device, to said setpoint generator, and to said flow adjuster, said circuit setting a level of the gas supply to said burner through said flow adjuster dependent upon said setpoint value received from said setpoint generator and dependent upon a measured temperature of the cooking vessel received from said sensing device; and a shielding disposed between said optical channel and said flame area, said shielding thermally separating said optical channel and the flames from one another.

25. In combination with a gas cooktop having at least one cooking zone with:

a gas burner for receiving a gas supply and for distributing flames at a flame area;

a flow adjuster fluidically connected to the burner and selectively supplying gas to the burner;

a cooking vessel support;

a sensing device for measuring a temperature of the cooking pot placed on the support, the temperature sensing device having:

an optical channel; and at least one infrared sensor for measuring temperature-dependent infrared radiation of the cooking pot;

a setpoint generator for setting a setpoint value;

an electric circuit connected to the sensing device, to the setpoint generator, and to the flow adjuster, the circuit setting a level of the gas supply to the burner through the flow adjuster dependent upon the setpoint value received from the setpoint generator and dependent upon a measured temperature of the cooking pot received from the sensing device; and a shielding disposed between the optical channel and the flame area, the shielding thermally separating the optical channel and the flames from one another;

a cooking pot comprising:

a body having a surface including a sensor surface, said body defining an interior;

said sensor surface disposed at a location on said surface at which the infrared sensor is directed; and said sensor surface having one of group consisting of a material, a color, and a surface finish reflecting infrared radiation in a temperature-dependent manner relatively higher than regions of said surface outside said sensor surface.

26. The pot according to claim 25, wherein said surface is an exterior surface of said body.

27. The pot according to claim 25, wherein:

said body has a bottom with a bottom surface; and said sensor surface is disposed at said bottom surface.

28. The pot according to claim 25, wherein:

said body has a side wall with a lateral exterior surface; and said sensor surface is disposed at said lateral exterior surface.

* * * * *